US011460259B2

(12) United States Patent
Dixon et al.

(10) Patent No.: US 11,460,259 B2
(45) Date of Patent: Oct. 4, 2022

(54) MAGAZINE CAP CHOKE ADAPTER

(71) Applicant: Rhino Chokes & Gun Works, LLC, Clearwater, FL (US)

(72) Inventors: Thomas Dixon, Clearwater, FL (US); Matthew Dixon, Clearwater, FL (US)

( * ) Notice: Subject to any disclaimer, the term of this patent is extended or adjusted under 35 U.S.C. 154(b) by 0 days.

(21) Appl. No.: 17/155,270

(22) Filed: Jan. 22, 2021

(65) Prior Publication Data

US 2022/0236024 A1 Jul. 28, 2022

(51) Int. Cl.
*F41A 9/72* (2006.01)
*F41A 21/32* (2006.01)
*F41A 21/40* (2006.01)

(52) U.S. Cl.
CPC ..... *F41A 9/72* (2013.01); *F41A 21/325* (2013.01); *F41A 21/40* (2013.01)

(58) Field of Classification Search
CPC ..... F41A 9/72; F41A 21/325; F41A 21/40; F41A 21/42
USPC ..... 42/49.02
See application file for complete search history.

(56) References Cited

U.S. PATENT DOCUMENTS

| | | | | | |
|---|---|---|---|---|---|
| 2,600,874 | A * | 6/1952 | Hoza | F41A 21/42 | 42/79 |
| 4,310,982 | A * | 1/1982 | Kast | F41A 9/72 | 42/49.01 |
| 4,602,449 | A * | 7/1986 | Holmes | F41A 9/72 | 42/49.02 |
| 4,736,540 | A * | 4/1988 | Holmes | F41A 21/40 | 42/49.01 |
| 4,953,316 | A * | 9/1990 | Litton, Sr. | F41C 23/22 | 42/90 |
| 5,303,859 | A * | 4/1994 | Jenkin | F41C 23/02 | 224/149 |
| 5,613,316 | A * | 3/1997 | Hightower | F41C 23/02 | 224/150 |
| 9,080,835 | B1 * | 7/2015 | Williford | F41C 27/00 | |
| 2004/0045209 | A1 * | 3/2004 | Nielsen | F41G 1/35 | 42/146 |
| 2015/0013204 | A1 * | 1/2015 | McNitt | F41C 27/16 | 42/90 |
| 2018/0259286 | A1 * | 9/2018 | Westcott | F41A 21/40 | |

* cited by examiner

*Primary Examiner* — Bret Hayes
(74) *Attorney, Agent, or Firm* — Larson & Larson, P.A.; Justin P. Miller; Frank Liebenow

(57) ABSTRACT

The disclosed magazine cap choke adapter allows a user to store an extra choke in place of the shotgun magazine cap. The magazine cap choke adapter is formed from a body that includes a first female threaded end, or proximal end, that threads onto the magazine adapter of the shotgun. Moving away from the proximal end, the magazine cap choke adapter tapers to a second female threaded end, or distal end, into which a choke is optionally threaded.

10 Claims, 9 Drawing Sheets

MAGAZINE CAP CHOKE ADAPTER

FIELD

This invention relates to the field of firearms and more particularly to a device that permits a shotgun choke to be affixed to a shotgun magazine.

BACKGROUND

A shotgun choke is a funnel or constriction for placement at the muzzle of a shotgun, the shape of constriction affecting the distribution of shot as it exits the firearm.

Differing distributions of shot are appropriate for differing conditions.

For example, when shooting birds or clay pigeons, a wide pattern is ideal, balanced against maintain sufficient density at long range to ensure multiple hits.

Given that the distance to the bird may differ over the course of a day, as different game is hunted or the birds are targeted at varying distances, multiple chokes are often required.

What is needed is a device for the ready storage of chokes on the shotgun, avoiding the need for a user to fumble in his pockets for the desired choke.

SUMMARY

The disclosed magazine cap choke adapter allows a user to store an extra choke in place of the shotgun magazine cap.

The magazine cap choke adapter is formed from a body that includes a first female threaded end, or proximal end, that threads onto the magazine adapter of the shotgun.

Moving away from the proximal end, the magazine cap choke adapter tapers to a second female threaded end, or distal end, into which a choke is optionally threaded.

The magazine cap choke adapter is optionally split near its center, permitting the addition of a strap attachment loop with strap slot.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
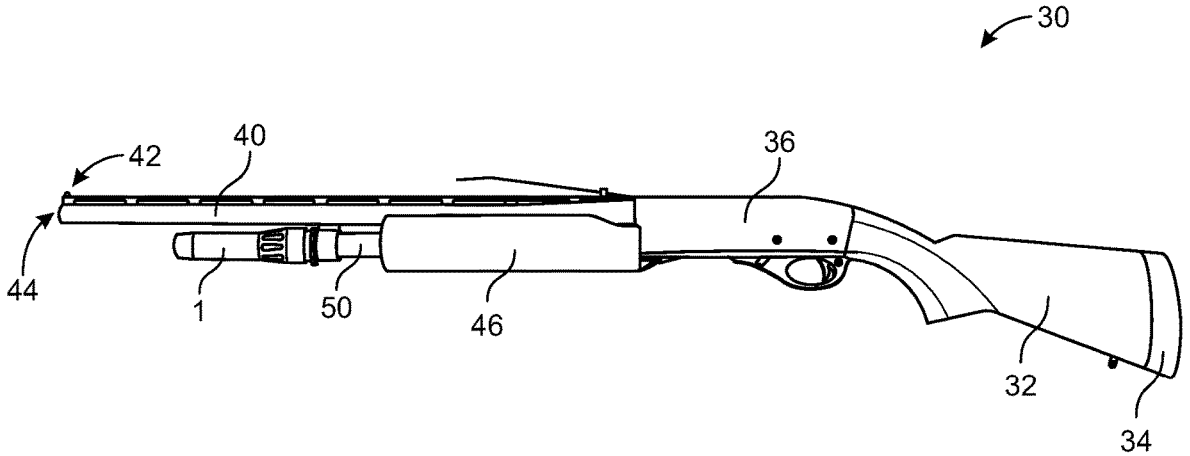
FIG. 1 illustrates a view of a shotgun with the magazine cap choke adapter.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of a shotgun with the magazine cap choke adapter is shown.

The magazine cap choke adapter 1, or body, is shown affixed to a typical firearm 30. The firearm 30 includes a stock 32, butt plate 34, receiver 36, fore-end 46, barrel 40, and muzzle 42 with muzzle internal threads 44.

Figure 2:
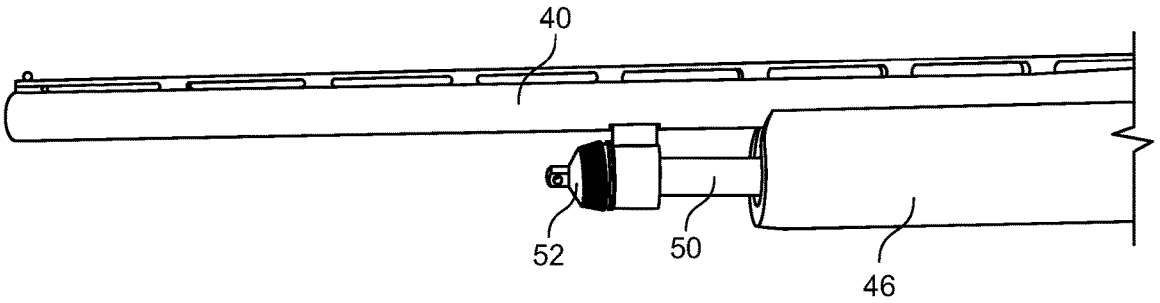
FIG. 2 illustrates a view of the front of the shotgun without the magazine cap choke adapter.

The magazine cap choke adapter 1 is affixed to the magazine 50, replacing the magazine cap 52 (see FIG. 2).

Referring to FIG. 2, a view of the front of the shotgun without the magazine cap choke adapter is shown.

Prior to installation, the typical firearm 30 (see FIG. 1) includes the fore-end 46 with the magazine 50 terminated at the magazine cap 52, all below the barrel 40.

Figure 3:
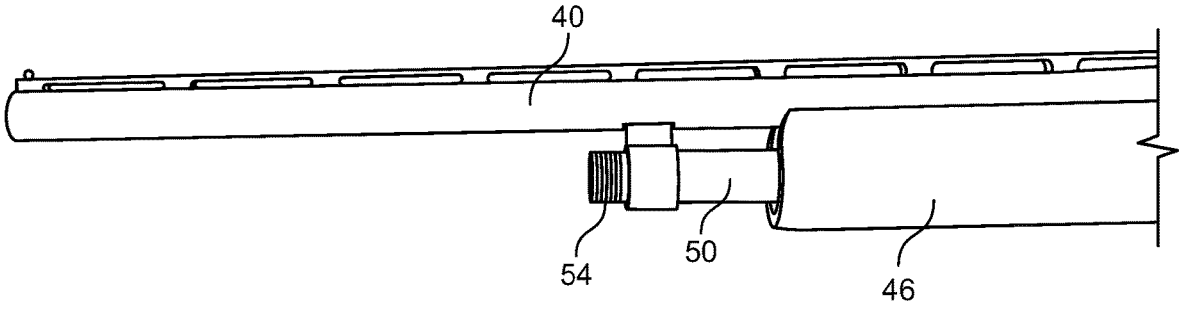
FIG. 3 illustrates a view of the front of the shotgun with the magazine cap removed, before mounting the magazine cap choke adapter.

Referring to FIG. 3, a view of the front of the shotgun with the magazine cap removed, before mounting the magazine cap choke adapter is shown.

With the magazine cap 52 (see FIG. 2) removed, the threaded magazine end 54 is visible.

Figure 4:
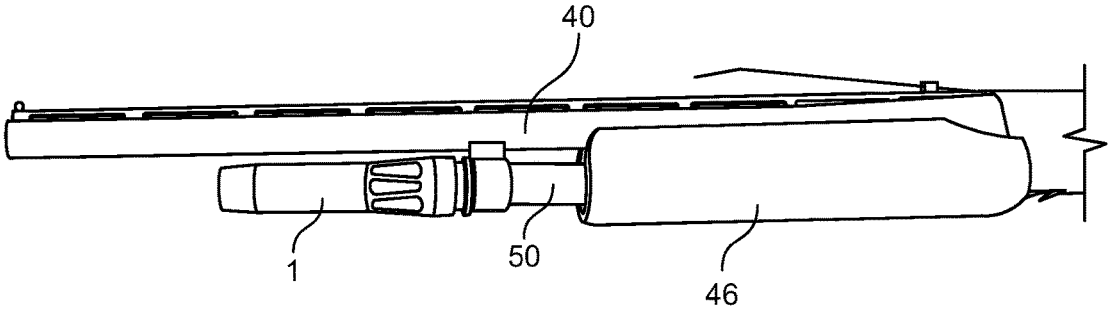
FIG. 4 illustrates a view of the front of the shotgun after mounting the magazine cap choke adapter.

Referring to FIG. 4, a view of the front of the shotgun after mounting the magazine cap choke adapter is shown.

The magazine cap choke adapter 1 is shown threaded over the threaded magazine end 54 (see FIG. 3).

Figure 5:
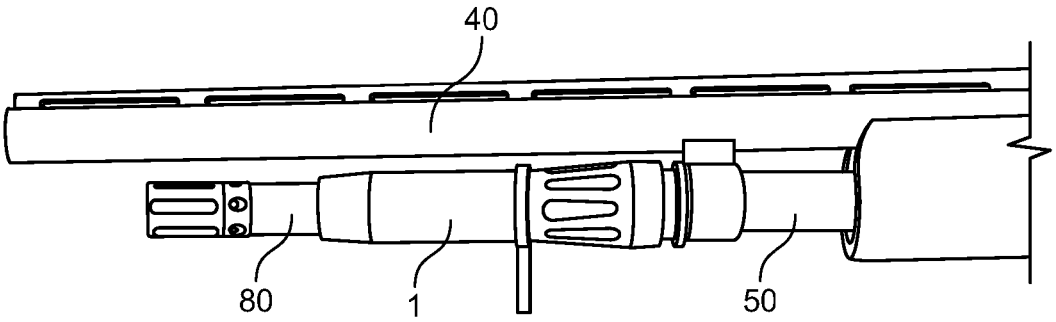
FIG. 5 illustrates a view of the front of the shotgun with a choke within the magazine cap choke adapter.

Referring to FIG. 5, a view of the front of the shotgun with a choke within the magazine cap choke adapter is shown.

The choke 80 is now shown threaded into the magazine cap choke adapter 1, thus allowing the choke 80 to be placed at the end of the magazine 50, near the muzzle 42.

After placement into the magazine cap choke adapter 1, the choke 80 is ready to transition to the barrel 40.

Figure 6:
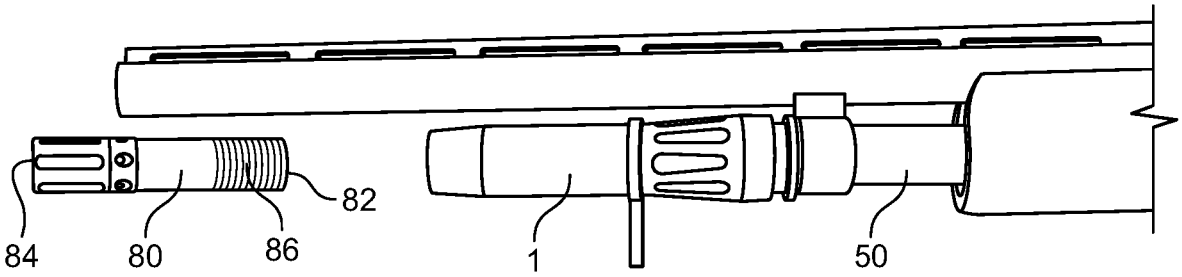
FIG. 6 illustrates a view of the front of the shotgun with the choke transitioning out of the magazine cap choke adapter.

Referring to FIG. 6, a view of the front of the shotgun with the choke transitioning out of the magazine cap choke adapter is shown.

With the choke 80 removed from the magazine cap choke adapter 1, the parts of the choke 80 are visible, specifically the choke proximal end 82, choke distal end 84, and choke external threads 86.

Figure 7:
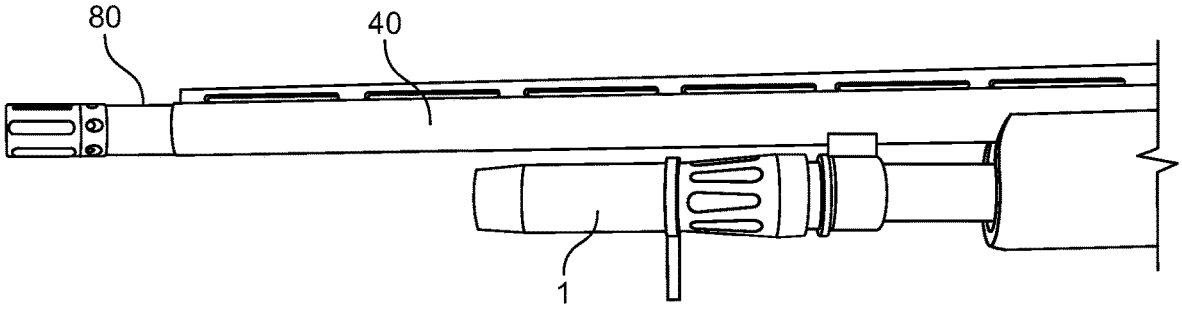
FIG. 7 illustrates a view of the front of the shotgun with the choke installed in the muzzle.

Referring to FIG. 7, a view of the front of the shot gun with the choke installed in the muzzle is shown.

The choke 80 is now installed into the muzzle 42 of the barrel 40. If the user desires, they may place a different choke 80 into the magazine cap choke adapter 1, allowing the chokes 80 to be swapped as desired.

Figure 8:
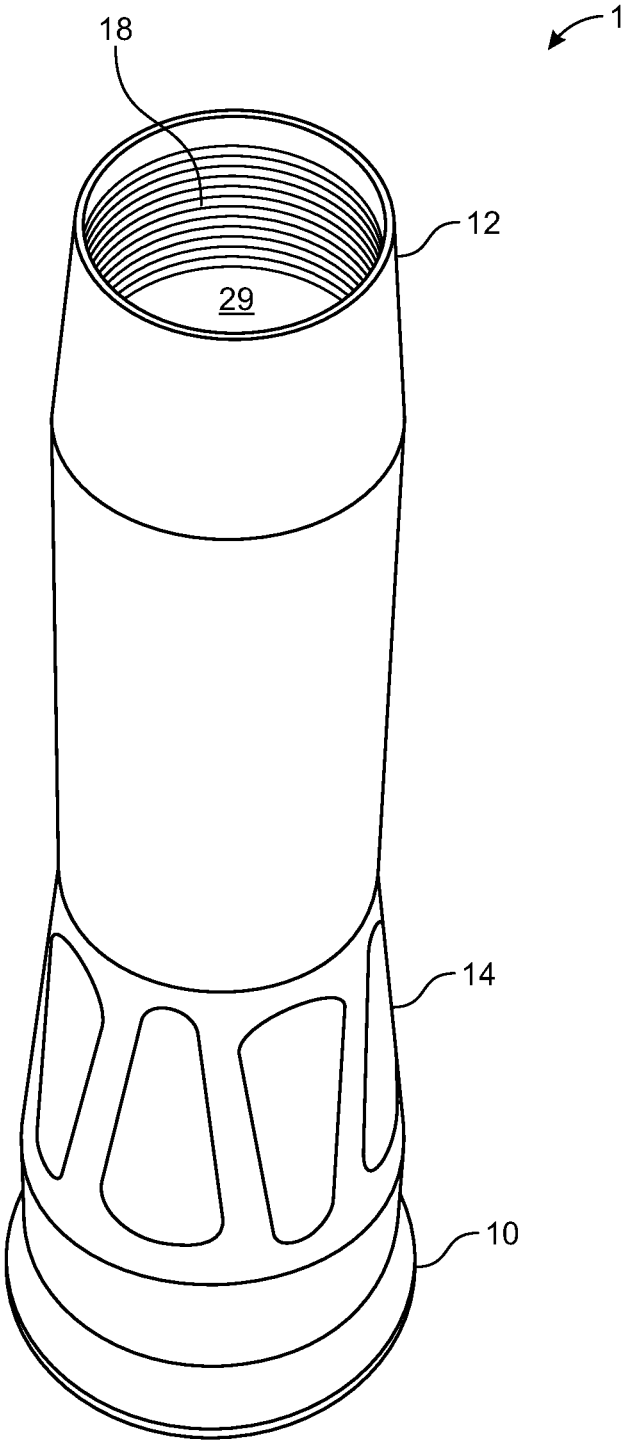
FIG. 8 illustrates a first view of the first embodiment of the magazine cap choke adapter.
Figure 9:
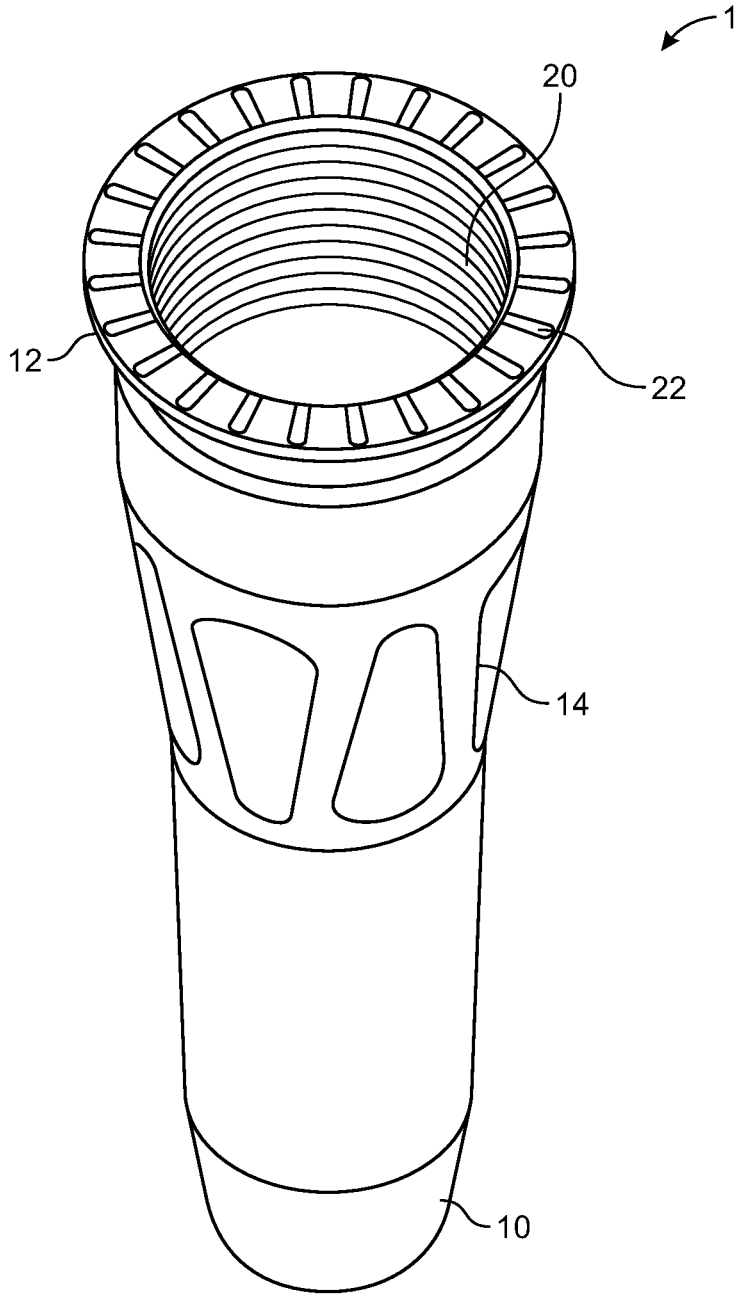
FIG. 9 illustrates a second view of the first embodiment of the magazine cap choke adapter.

Referring to FIGS. 8 and 9, a first and second view of the first embodiment of the magazine cap choke adapter are shown.

The first embodiment of the magazine cap choke adapter 1 includes a choke adapter proximal end 10, a choke adapter distal end 12, a flare 14, distal internal threads 18, proximal internal threads 20, and anti-rotation grooves 22.

The diameter of the choke adapter proximal end 10 is generally less than the diameter of the choke adapter distal end 12.

Figure 10:
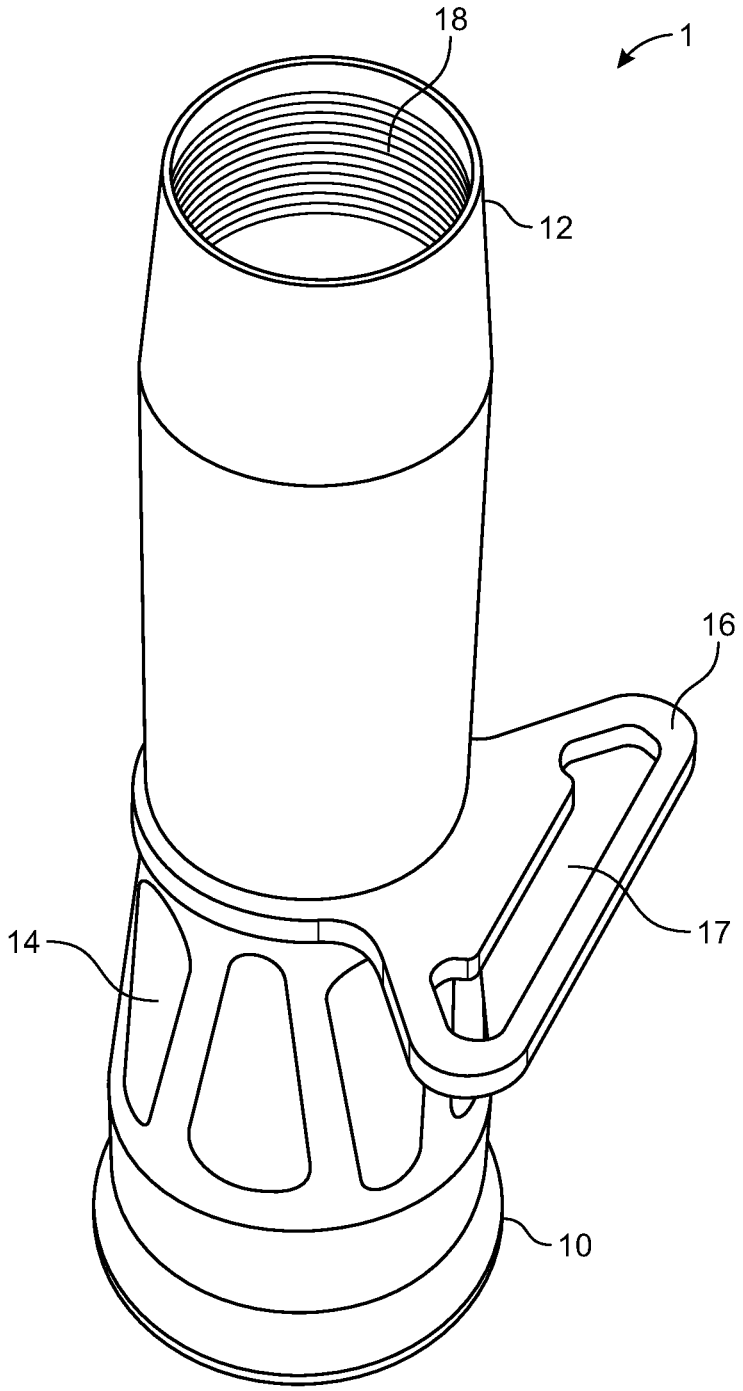
FIG. 10 illustrates a first view of the second embodiment of the magazine cap choke adapter.
Figure 11:
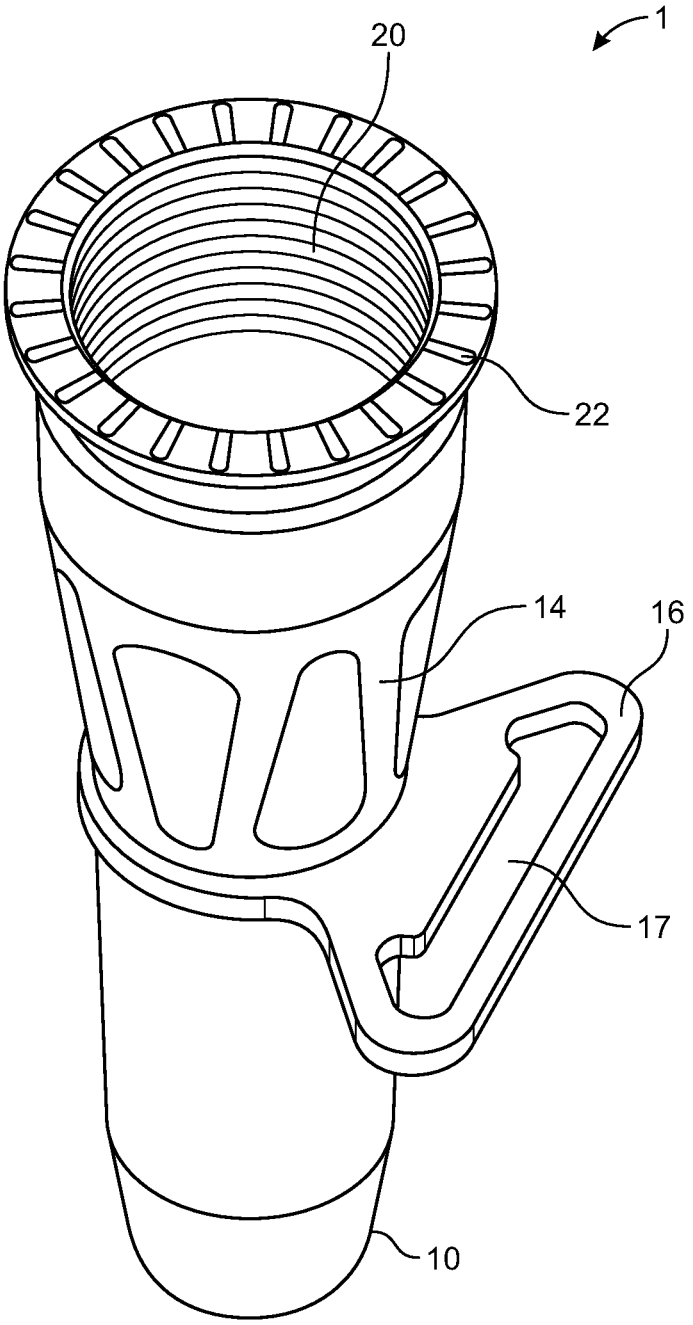
FIG. 11 illustrates a second view of the second embodiment of the magazine cap choke adapter.
Figure 12:
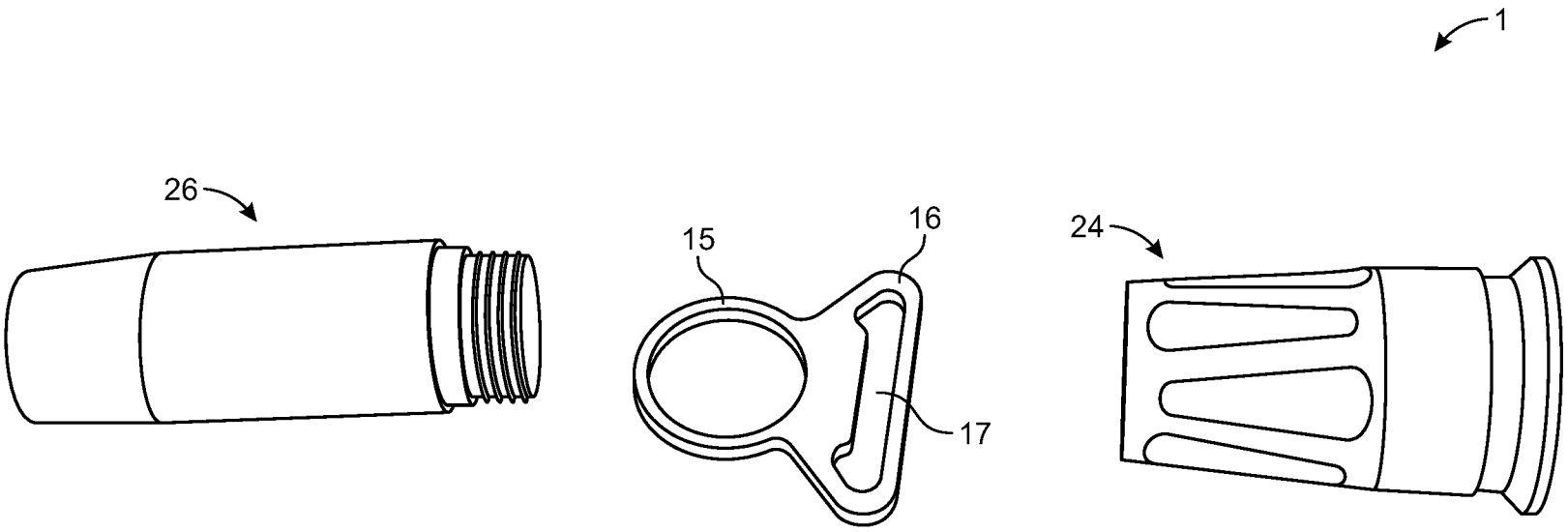
FIG. 12 illustrates a disassembled view of the second embodiment of the magazine cap choke adapter.

Referring to FIGS. 10, 11, and 12, a first, second, and third view of the second embodiment of the magazine cap choke adapter are shown.

The second embodiment of the magazine cap choke adapter 1 separates into discrete pieces including a choke adapter proximal end 10, a choke adapter distal end 12, a flare 14, distal internal threads 18, proximal internal threads 20, and anti-rotation grooves 22.

Further included are mounting ring 15, strap attachment loop 16, strap slot 17. The magazine cap choke adapter 1 is formed from the combination of a choke adapter proximal half 24 and choke adapter distal half 26 that interface at the choke adapter midline threads 28.

Also shown is the hollow internal space, or choke adapter internal space 29.

Equivalent elements can be substituted for the ones set forth above such that they perform in substantially the same manner in substantially the same way for achieving substantially the same result.

It is believed that the system and method as described and many of its attendant advantages will be understood by the foregoing description.

It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device for storage of a choke on a shotgun, the device comprising:

a proximal end;

proximal internal threads within the proximal end;

the proximal internal threads to interface with an end of a magazine of the shotgun;

a distal end;

a flaring transition between the proximal end and the distal end;

distal internal threads within the distal end;

the distal internal threads to interface with the choke;

wherein the device is hollow with an internal space of constant diameter connecting the proximal end to the distal end.

2. The device of claim 1, further comprising:

anti-rotation grooves;

the anti-rotation grooves on a face adjacent to the proximal end;

the anti-rotation grooves discouraging rotation of the device with respect to the shotgun, thus avoiding accidental detachment of the device from the shotgun.

3. The device of claim 1, wherein the device separates into two or more discrete pieces.

4. The device of claim 3, wherein the two or more discrete pieces are removably joined at a set of midline threads.

5. The device of claim 4, further comprising:

a mounting ring with strap attachment loop, the strap attachment loop defining a strap slot;

the mounting ring held between the two or more discrete pieces of the device;

the strap slot to allow a user to affix a strap to the device.

6. A device that affixes a choke to a shotgun by replacing a magazine cap, the device comprising:

a body with a proximal end and a distal end;

the proximal end including internal proximal threads;

the distal end including internal distal threads;

the proximal end having a larger diameter than the distal end;

wherein the body is hollow, without a barrier or constriction between the proximal end and the distal end;

wherein the proximal end of the device threads onto a threaded magazine end of the shotgun.

7. The device of claim 6, further comprising:

anti-rotation grooves;

the anti-rotation grooves on a face adjacent to the proximal end;

the anti-rotation grooves discouraging rotation of the device with respect to the shotgun, thus avoiding accidental detachment of the device from the shotgun.

8. The device of claim 6, wherein the device separates into two or more discrete pieces.

9. The device of claim 8, wherein the two or more discrete pieces are removably joined at a set of midline threads.

10. The device of claim 9, further comprising:

a mounting ring with strap attachment loop, the strap attachment loop defining a strap slot;

the mounting ring held between the two or more discrete pieces of the device;

the strap slot to allow a user to affix a strap to the device.

* * * * *